US012239240B2

(12) United States Patent
Li et al.

(10) Patent No.: US 12,239,240 B2
(45) Date of Patent: Mar. 4, 2025

(54) EXTENDABLE SEATING INTERCONNECTED MECHANISM AND SEATING SUPPORTING FRAME

(71) Applicant: Remacro Technology Co., Ltd., Jiangsu (CN)

(72) Inventors: Xiaohong Li, Jiangsu (CN); Xiaoqiang Zhang, Jiangsu (CN); Zhanzheng Lv, Jiangsu (CN)

(73) Assignee: Remacro Technology Co., Ltd., Suzhou (CN)

( * ) Notice: Subject to any disclaimer, the term of this patent is extended or adjusted under 35 U.S.C. 154(b) by 84 days.

(21) Appl. No.: 18/128,303

(22) Filed: Mar. 30, 2023

(65) Prior Publication Data

US 2023/0232986 A1 Jul. 27, 2023

Related U.S. Application Data

(63) Continuation of application No. PCT/CN2021/121427, filed on Sep. 28, 2021.

(30) Foreign Application Priority Data

Sep. 30, 2020 (CN) ..... 202011069268.2
Sep. 30, 2020 (CN) ..... 202011069718.8

(51) Int. Cl.
*A47C 1/0355* (2013.01)
*A47C 7/14* (2006.01)
(Continued)

(52) U.S. Cl.
CPC ..... *A47C 7/144* (2018.08); *A47C 1/0355* (2013.01); *A47C 7/462* (2013.01); *A47C 7/506* (2013.01)

(58) Field of Classification Search
CPC ..... A47C 1/0355
See application file for complete search history.

(56) References Cited

U.S. PATENT DOCUMENTS 4,077,663 A * 3/1978 Cycowicz ..... A47C 1/0352 297/83 X
4,306,746 A * 12/1981 Crum ..... A47C 1/0355 297/85 R X (Continued)

FOREIGN PATENT DOCUMENTS

CN 111602993 A 9/2020

OTHER PUBLICATIONS

International Search Report of PCT Patent Application No. PCT/CN2021/121427 issued on Jan. 5, 2022.

*Primary Examiner* — Rodney B White

(57) ABSTRACT

An extendable seating interconnected mechanism and a seating supporting frame, including an interconnected assembly, a seating frame, and a backrest mount, wherein the backrest mount is rotatably connected to the interconnected assembly and the seating frame, respectively; the interconnected assembly includes a mounting plate and a driving link, wherein the mounting plate includes a lateral-plate part and a supporting part; the driving link is rotatably connected between the seating frame and the lateral-plate part; an end of the supporting part is connected to the lateral-plate part; and an opposite end of the supporting part is rotatably connected to the backrest mount. The interconnected mechanism and the seating supporting frame optimize and simplify the structure, leading to a compression of the height of the seating supporting frame; different seating positions may be adjusted smoother by connecting the extendable and retractable footrest mechanism and interconnected assembly, which improves the seating comfort.

12 Claims, 5 Drawing Sheets

(51) Int. Cl.
*A47C 7/46* (2006.01)
*A47C 7/50* (2006.01)

(56) References Cited

U.S. PATENT DOCUMENTS 4,337,977 A * 7/1982 Rogers, Jr. ..... A47C 1/0355 297/85 L
4,350,386 A * 9/1982 Rogers, Jr. ..... A47C 1/0355 297/85 R X
4,350,387 A * 9/1982 Rogers, Jr. ..... A47C 1/0355 297/85 R X
4,577,902 A * 3/1986 Crum ..... A47C 1/0355 297/85 L
4,815,788 A * 3/1989 May ..... A47C 1/0355 297/85 L
4,878,710 A * 11/1989 Tacker ..... A47C 1/0355 297/85 L X
4,904,019 A * 2/1990 May ..... A47C 1/0355 297/85 R X
4,989,914 A * 2/1991 Pine ..... A47C 1/0355 297/85 L
5,072,988 A * 12/1991 Plunk ..... A47C 1/0352 297/85 L
5,186,518 A * 2/1993 Pine ..... A47C 1/0355 297/85 L
5,292,170 A * 3/1994 LaPointe ..... A47C 1/0352 297/68
5,360,255 A * 11/1994 Cook ..... A47C 1/0355 297/85 R X
5,527,092 A * 6/1996 Cook ..... A47C 1/0355 297/85 R X
5,800,010 A * 9/1998 May ..... A47C 1/0355 297/85 L
5,975,627 A * 11/1999 LaPointe ..... A47C 1/0355 297/83
5,992,930 A * 11/1999 LaPointe ..... A47C 1/0352 297/83
6,145,924 A * 11/2000 Mero, Jr. ..... A47C 1/0355 297/83
6,409,262 B1 * 6/2002 LaPointe ..... A47C 1/0352 297/83

* cited by examiner

EXTENDABLE SEATING INTERCONNECTED MECHANISM AND SEATING SUPPORTING FRAME

CROSS REFERENCE TO RELATED APPLICATIONS

The present application is a Continuation Application of PCT Application No. PCT/CN2021/121427 filed on Sep. 28, 2021, which claims the benefit of Chinese Patent Application Nos. 202011069718.8 and 202011069268.2 filed on Sep. 30, 2020. All the above are hereby incorporated by reference in their entirety.

FIELD OF THE INVENTION

The present invention relates to the field of furniture manufacturing, in particular to an extendable seating interconnected mechanism and seating supporting frame.

BACKGROUND OF THE INVENTION

With the gradual improvement of people's living standards, intelligent furniture, including sofas, recliners, office chairs, theatre chairs, and other seats, become increasingly functional, which may not only meet the demand for different positions but also provide better relaxation for the body.

At present, the interconnected structure for adjusting the position of the seat in the prior art is generally complex, leading to a poor transformation of the position, a relatively high overall structure, a large volume, and a large space occupation of the seating supporting frame unit, which not only takes up space during transport and increases transport costs but is also bulky when in use, affecting the overall appearance and comfort of the sofa.

SUMMARY OF INVENTION

The purpose of the present invention is to overcome the complex structure, relatively high height, large size, and jamming and lagging seating position adjustment of the seating supporting frame in the prior art.

In order to realize the purpose mentioned above, an extendable seating interconnected mechanism is provided in the present invention, comprising an interconnected assembly, a seating frame, and a backrest mount, wherein the backrest mount is rotatably connected to the interconnected assembly and the seating frame, respectively; the interconnected assembly comprises a mounting plate and a driving link, wherein the mounting plate comprises a lateral-plate part and a supporting part; the driving link is rotatably connected between the seating frame and the lateral-plate part; an end of the supporting part is connected to the lateral-plate part; and an opposite end of the supporting part is rotatably connected to the backrest mount.

Further, the lateral-plate part is fixedly connected to the supporting part, or the lateral-plate part and the supporting part are integrally formed into an L-shape.

Further, an angle between the lateral-plate part and the supporting part is between 90 and 100 degrees.

Further, the backrest mount is bent and formed integrally into a first segment, a second segment, and a third segment; the first segment is rotatably connected to a side of the seating frame; the second segment is rotatably connected to the supporting part; and the third segment is connected to the backrest frame of the seat.

A seating supporting frame is further provided in the present invention, comprising an interconnected assembly, a seating frame, a backrest mount, and a first transmitting part, wherein the backrest mount is rotatably connected to the interconnected assembly and the seating frame, respectively; the interconnected assembly comprises a mounting plate and a driving link, wherein the mounting plate comprises a lateral-plate part and a supporting part; the driving link is rotatably connected between the seating frame and the lateral-plate part; an end of the supporting part is connected to the lateral-plate part; an opposite end of the supporting part is rotatably connected to the backrest mount; an end of the first transmitting part is connected to an extendable and retractable footrest mechanism of a seat; an opposite end of the first transmitting part is connected to the lateral-plate part; and the interconnected assembly transmits pull forces to an extendable and retractable footrest mechanism through the first transmitting part.

In addition, the seating supporting frame further comprises a second transmitting part, wherein the second transmitting part is obliquely provided between the seating frame and the lateral-plate part; an end of the second transmitting part is connected to a sidewall of the seating frame; and an opposite end of the second transmitting part is connected to an end, near the supporting part, of the lateral-plate part.

Further, a first hinge point and a second hinge point are provided on two ends of the lateral-plate part; the lateral-plate part is connected to the driving link through the first hinge point; and the lateral-plate part is connected to the supporting part through the second hinge point.

In addition, a first fixing part is further provided on the lateral-plate part, wherein a ratio of a distance between the first fixing part and the first hinge point to a distance between the first fixing part and the second hinge point is greater than one; and the first fixing part is connected to an end of the first transmitting part.

Further, a second fixing part is further provided on the lateral-plate part, wherein a ratio of a distance between the second fixing part and the first hinge point to a distance between the second fixing part and the second hinge point is greater than two; and the second fixing part is connected to an end of the second transmitting part.

Further, the first transmitting part and the second transmitting part are elastic connectors with elastic recovery.

In addition, the seating supporting frame further comprises an extendable and retractable footrest mechanism, wherein the extendable and retractable footrest mechanism comprises a link assembly, a main footrest part, and a sub-footrest part assembly; the link assembly is used for driving the main footrest part and the sub-footrest assembly to extend or retract relative to the seating frame; the link assembly comprises a first link, a second link, a third link, and a fourth link, wherein the first link is connected to the second link, and the third link is connected to the fourth link; a central part of the second link is crossly connected to a central part of the third link; the first link and the third link are connected to the seating frame, respectively; and the second link and the fourth link are connected to the main footrest part, respectively.

In addition, the extendable and retractable footrest mechanism further comprises a transmitting connecting part, wherein the transmitting connecting part is provided on a side where the extendable and retractable footrest mechanism is connected to the first transmitting part; an end of the transmitting connecting part is rotatably connected to the first link; and an opposite end of the transmitting connecting part is connected to the first transmitting part.

Further, oppositely provided on the seating supporting frame are two sets of the interconnected assembly, the seating frame, the backrest mount, the first transmitting part, and the extendable and retractable footrest mechanism.

In addition, the seating supporting frame further comprises a transverse mounting link, a transverse driving link, and a driving mechanism, wherein two ends of the transverse mounting link are connected to two supporting parts, respectively; two ends of the transverse driving link are connected to a central part of two first links, respectively; and the driving mechanism is provided between the transverse driving link and the transverse mounting link, so as to enable the seating supporting frame to be switched between seated, extended, and reclined positions.

In comparison with the prior art, the present invention provides beneficial effects as follows: the structure of the extendable seating interconnected mechanism is optimized and simplified in the present invention, leading to a reduction of the manufacturing cost and a compression of the overall height of the seating supporting frame; a seat may be adjusted smoother during retracting from the reclined position by connecting the extendable and retractable footrest mechanism and the interconnected assembly through transmitting parts, which improves the comfort of the seat.

BRIEF DESCRIPTION OF THE DRAWINGS

In order to illustrate more clearly the technical solutions in the embodiments of the present invention or in the prior art, provided hereinafter is a brief description of the attached drawings required for the description of the embodiments or of the prior art. Obviously, the attached drawings in the following description are only some embodiments of the present invention, and other drawings may be obtained on the basis of these attached drawings without any inventive effort by those of ordinary skill in the art.

1: interconnected assembly; 2: first transmitting part; 22: second transmitting part; 10: mounting plate; 11: driving link; 12: lateral-plate part; 13: supporting part; 3: seating frame; 4: backrest mount; 5: extendable and retractable footrest mechanism; 121: first hinge point; 122: second hinge point; 123: first fixing part; 124: second fixing part; 41: first segment; 42: second segment; 43: third segment; 51: link assembly; 511: first link; 512: second link; 513: third link; 514: fourth link; 52: main footrest part; 53: sub-footrest part assembly; 531: sub-footrest part; 532: footrest link; 54: transmitting connecting part; 6: transverse mounting link; 7: transverse driving link; 200: armrest frame; 400: backrest frame.

DETAILED DESCRIPTION OF THE PREFERRED EMBODIMENTS

In order to provide a better understanding of the purpose, technical solutions, and advantages of the present invention, the invention is described hereinafter with further details in conjunction with specific embodiments and with reference to the attached drawings. It should be understood that these descriptions are only exemplary and are not intended to limit the scope of the present invention.

In the description of the invention, it is to be understood that ordinal terms such as "first", "second" and "third" are used for descriptive purposes only and are not to be understood as indicating or implying relative importance or implicitly specifying the quantity of the indicated technical feature. Thus, features identified with "first" and "second" may explicitly or implicitly include one or more of those features.

Furthermore, in the present invention, the terms "mount", "connect", etc., should be understood in a broad sense unless otherwise explicitly specified and limited. For example, it may be a fixed connection, a detachable connection, or an integral body; it may be a mechanical connection or an electrical connection; it may be a direct connection or an indirect connection through an intermediate medium; and it may be a connection within two components. To those of ordinary skill in the art, the actual meaning of the above terms in the present invention may be understood according to the actual situation.

The extendable seating interconnected mechanism and the seating supporting frame in the present invention may be applied to sofas, office chairs, lounge chairs, and other seats, in which seated, extended, and reclined positions of seats may be realized. Further, in the seated position, the seating frame is in general horizontal and the backrest is substantially perpendicular to the seating frame; in the extended position, the extendable and retractable footrest mechanism extends forward; in the reclined position, the backrest and the backrest mount rotates backward relative to the seating frame on the basis of the extended position, so that a seat may be reclined.

Embodiment

Figure 1:
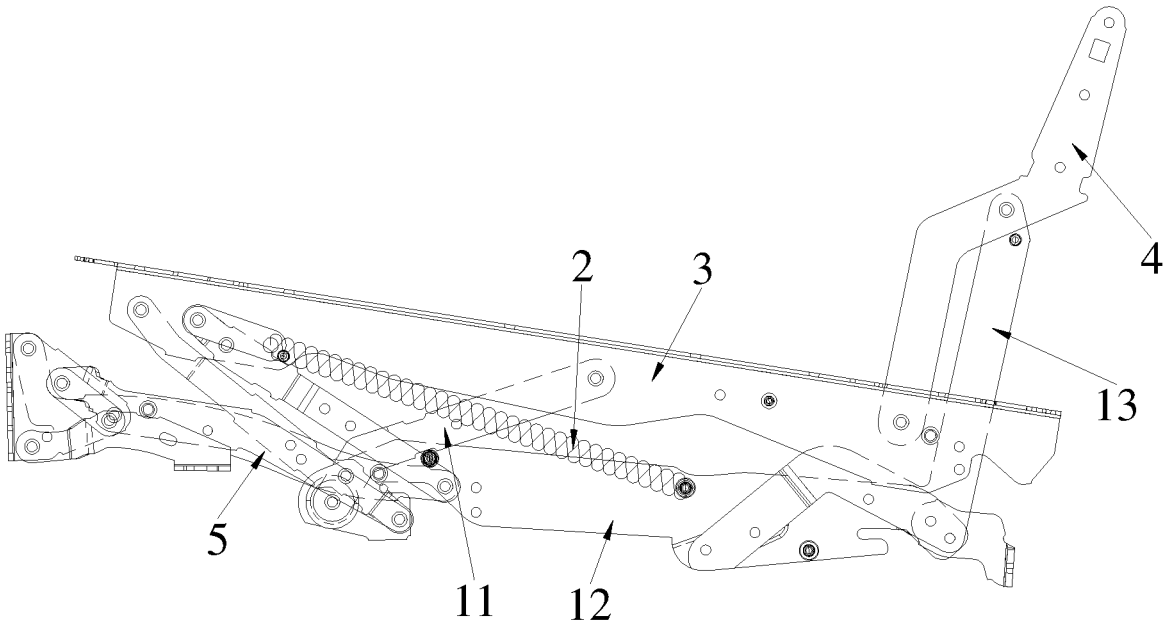
FIG. 1 is a structural diagram of an extendable seating interconnected mechanism in a seated position in the embodiment of the present invention.
Figure 2:
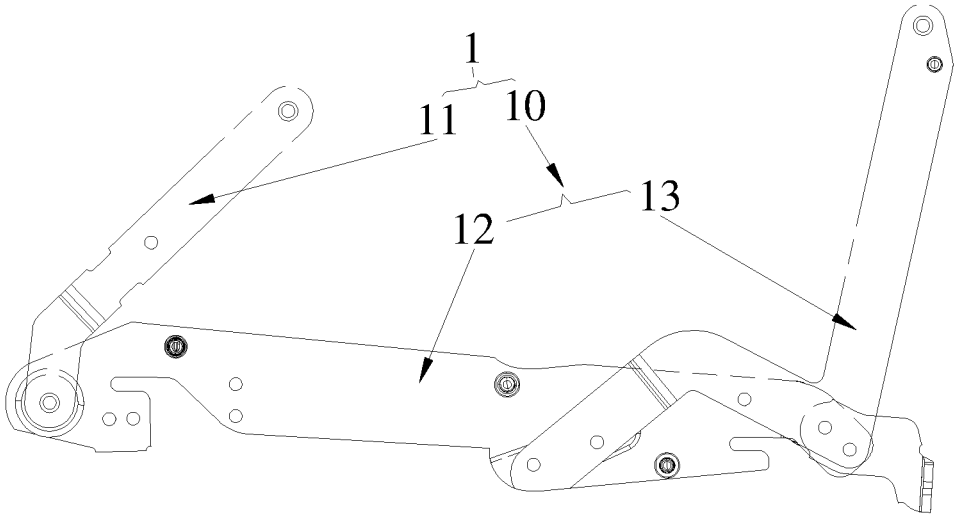
FIG. 2 is a structural diagram of the interconnected assembly in the embodiment of the present invention.

As shown in FIG. 1, an extendable seating interconnected mechanism is provided in the embodiment of the present invention, comprising an interconnected assembly 1, a seating frame 3, and a backrest mount 4, wherein the backrest mount 4 is rotatably connected to the interconnected assembly 1 and the seating frame 3, respectively; as shown in FIG. 2, the interconnected assembly 1 comprises a mounting plate 10 and a driving link 11, wherein the mounting plate 10 comprises a lateral-plate part 12 and a supporting part 13; the driving link 11 is rotatably connected between the seating frame 3 and the lateral-plate part 12; the supporting part 13 is connected to the lateral-plate part 12; and the supporting part 13 is rotatably connected to the backrest mount 4 of a seat.

Specifically, the lateral-plate part 12 is fixedly connected to the supporting part 13, or the lateral-plate part 12 and the supporting part 13 are integrally formed into an L-shape. An angle between the lateral-plate part 12 and the supporting part 13 is between 90 and 100 degrees. The lateral-plate part 12 and the supporting part 13 may be two separate parts that are fixedly connected by fasteners, which may improve the utilization of the product during the manufacturing process. In some embodiments, the lateral-plate part 12 and the supporting part 13 may also be an integrally bent and formed L-shaped assembly, which may be integrally forged and leads to a reduction of manufacturing steps. In the embodiment of the present invention, the supporting part 13 extends in the direction of the lateral-plate part 12 to form a fixed connection close to the middle of the lateral-plate part 12, which forms a bent shape and may lead to an increase of the overall structural strength of the interconnected assembly 1.

Specifically, the backrest mount 4 is bent and formed integrally into a first segment 41, a second segment 42, and a third segment 43; the first segment 41 is rotatably connected to a side of the seating frame 3; the second segment 42 is rotatably connected to the supporting part 13; and the third segment 43 is connected to the backrest frame of the seat. Specifically, the third segment 43 of the backrest mount 4 may be a structure like an insertion piece connected to the backrest frame of a seat by inserting. The backrest mount 4 may also be bent to a mount like a Z-shape.

A seating supporting frame is further provided in the embodiment of the present invention, comprising an interconnected assembly 1, a seating frame 3, a backrest mount 4, and a first transmitting part 2, wherein the backrest mount 4 is rotatably connected to the interconnected assembly 1 and the seating frame 3, respectively; the interconnected assembly 1 comprises a mounting plate 10 and a driving link 11, wherein the mounting plate 10 comprises a lateral-plate part 12 and a supporting part 13; the driving link 11 is rotatably connected between the seating frame 3 and the lateral-plate part 12; an end of the supporting part 13 is connected to the lateral-plate part 12; an opposite end of the supporting part 13 is rotatably connected to the backrest mount 4.

Specifically, an end of the first transmitting part 2 is connected to an extendable and retractable footrest mechanism 5 of a seat; an opposite end of the first transmitting part 2 is connected to the lateral-plate part 12; the interconnected assembly 1 transmits pull forces to an extendable and retractable footrest mechanism 5 through the first transmitting part 2; and the first transmitting part 2 is extended as the extendable and retractable footrest mechanism 5 is extended forward. Specifically, the first transmitting part 2 may be an elastic connector with elastic recovery. In the present embodiment, the first transmitting part 2 may be a spring with hooks or rings at both ends, or a structure such as an elastic cord or an elastic zip in some other embodiments.

Figure 4:
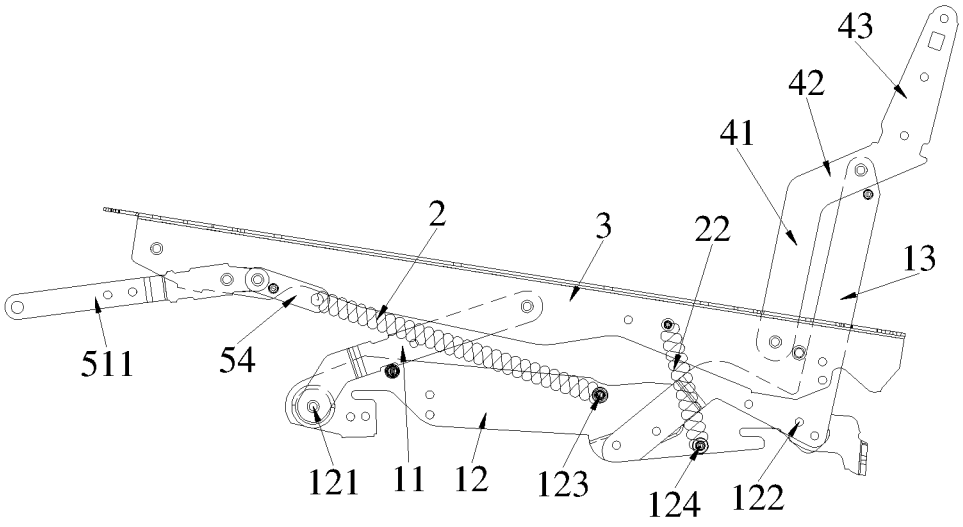
FIG. 4 is a structural diagram of a partial structure of the seating supporting frame in an extended position in the embodiment of the present invention.

Specifically, as shown in FIG. 4, the seating supporting frame further comprises a second transmitting part 22, wherein the second transmitting part 22 is obliquely provided between the seating frame 3 and the lateral-plate part 12; an end of the second transmitting part 22 is connected to a sidewall of the seating frame 3; and an opposite end of the second transmitting part 22 is connected to an end, near the supporting part 13, of the lateral-plate part 12. The second transmitting part 22 is used to maintain the elastic force for restoration between the seating frame 3 and the lateral-plate part 12, thereby leading to a faster and smoother retraction of the seating frame 3. The second transmitting part 22 may be an elastic connector with elastic recovery, which may be a spring, elastic cord, or other connection with elastic force.

Figure 5:
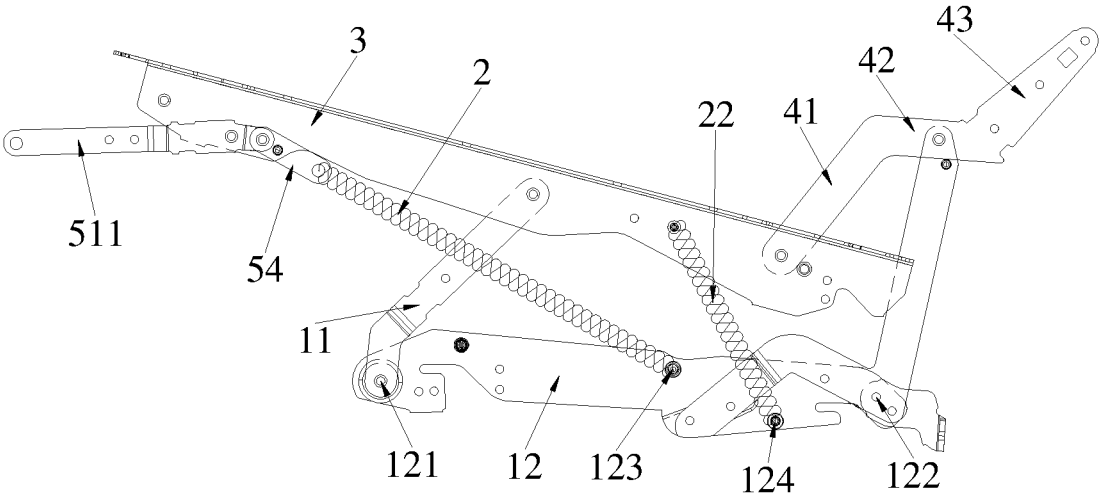
FIG. 5 is a structural diagram of a partial structure of the seating supporting frame in a reclined position in the embodiment of the present invention.

Specifically, as shown in FIG. 4 and FIG. 5, a first hinge point 121 and a second hinge point 122 are provided on two ends of the lateral-plate part 12; the lateral-plate part 12 is connected to the driving link 11 through the first hinge point 121; and the lateral-plate part 12 is connected to the supporting part 13 through the second hinge point 122. The driving link 11 is rotatably connected to the central lateral edge of the seating frame 3. In practice, the lateral-plate part 12 is used for fixed connection to the seating armrests on two sides. The lateral-plate part 12 is provided with mounting hooks, positioning holes or positioning columns for connection to the frame of the seating armrests.

Specifically, a first fixing part 123 is further provided on the lateral-plate part 12, wherein a ratio of a distance between the first fixing part 123 and the first hinge point 121 to a distance between the first fixing part 123 and the second hinge point 122 is greater than one; and the first fixing part 123 is connected to an end of the first transmitting part 2. A second fixing part 124 is further provided on the lateral-plate part 12, wherein a ratio of a distance between the second fixing part 124 and the first hinge point 121 to a distance between the second fixing part 124 and the second hinge point 122 is greater than two; and the second fixing part 124 is connected to an end of the second transmitting part 22. Specifically, the second fixing part 124 is closer to the second hinge point 122 than the first hinge point 121, and the fixing position of the second fixing part 124 is close to the lower edge of the lateral-plate part 12. The first fixing part 123 and the second fixing part 124 may be fixing screws, hooks, pins, or other parts with a fixing or hooking function.

Specifically, in the present embodiment, the interconnected assembly 1 is provided between the seating frame 3 and the backrest mount 4, which is used for supporting and driving the backrest mount 4 to rotate relative to the seating frame 3 during the adjustment of the seating position.

During extension, the seating frame 3 is rotated upwards at an inclined angle by the extendable and retractable footrest mechanism 5, which is tightened by the first transmitting part 2. When the seat is retracted from the reclined position, the seating frame 3 is smoothly rotated and retracted by the elastic force for restoring the second transmitting part 22 and by its gravity.

Figure 3:
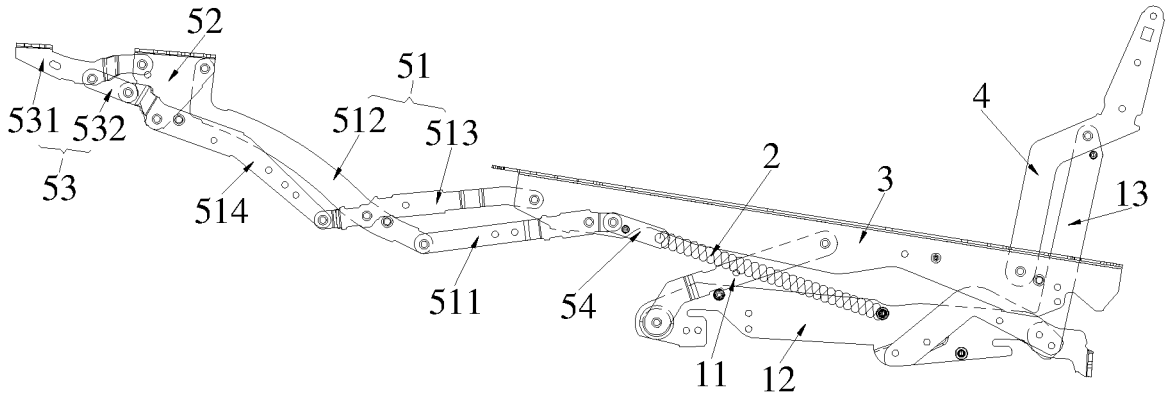
FIG. 3 is a structural diagram of a seating supporting frame in an extended position in the embodiment of the present invention.

Specifically, the seating supporting frame further comprises an extendable and retractable footrest mechanism 5, as shown in FIG. 3, wherein the extendable and retractable footrest mechanism 5 comprises a link assembly 51, a main footrest part 52, and a sub-footrest part assembly 53; the link assembly 51 is used for driving the main footrest part 52 and the sub-footrest assembly 53 to extend or retract relative to the seating frame 3; the link assembly 51 comprises a first link 511, a second link 512, a third link 513 and a fourth link 514, wherein the first link 511 is connected to the second link 512, and the third link 513 is connected to the fourth link 514; a central part of the second link 512 is crossly connected to a central part of the third link 513; the first link 511 and the third link 513 are connected to the seating frame 3, respectively; and the second link 512 and the fourth link 514 are connected to the main footrest part 52, respectively.

Specifically, the sub-footrest assembly 53 comprises sub-footrest part 531 and footrest link 532, wherein the sub-footrest part 531 is connected to the main footrest part 52, wherein the sub-footrest part 531 is connected to the fourth link 514 through the footrest link 532. In the present embodiment, the main footrest part 52 and the sub-footrest part 531 are used to mount a main footrest and a sub-footrest, respectively. In some embodiments, the extendable and retractable footrest mechanism 5 may comprise a different quantity of footrests, such as one, two, or three; the extended length of the extendable and retractable footrest mechanism 5 also varies.

Specifically, the extendable and retractable footrest mechanism 5 further comprises a transmitting connecting part 54, wherein the transmitting connecting part 54 is provided on a side where the extendable and retractable footrest mechanism 5 is connected to the first transmitting part 2; an end of the transmitting connecting part 54 is rotatably connected to the first link 511; and an opposite end of the transmitting connecting part 54 is connected to the first transmitting part 2.

Specifically, oppositely provided on the seating supporting frame in the present embodiment are two sets of the interconnected assembly 1, the seating frame 3, the backrest mount 4, the first transmitting part 2, and the extendable and retractable footrest mechanism 5.

Specifically, the seating supporting frame further comprises a transverse mounting link 6, a transverse driving link 7, and a driving mechanism, wherein two ends of the transverse mounting link 6 are connected to two supporting parts 13, respectively; two ends of the transverse driving link 7 are connected to a central part of two first links 511, respectively; and the driving mechanism is provided between the transverse driving link 7 and the transverse mounting link 6, so as to enable the seating supporting frame to be switched between seated, extended, and reclined positions. Specifically, the driving mechanism is a linear drive, which may be a pusher motor; only one pusher motor is required to realize the seating adjustment between three positions in the present embodiment. The side near the motor of the driving mechanism is connected to the transverse mounting link 6 through a mounting part; the side near the pusher of the driving mechanism is connected to the transverse driving link 7 through a mounting part.

Figure 6:
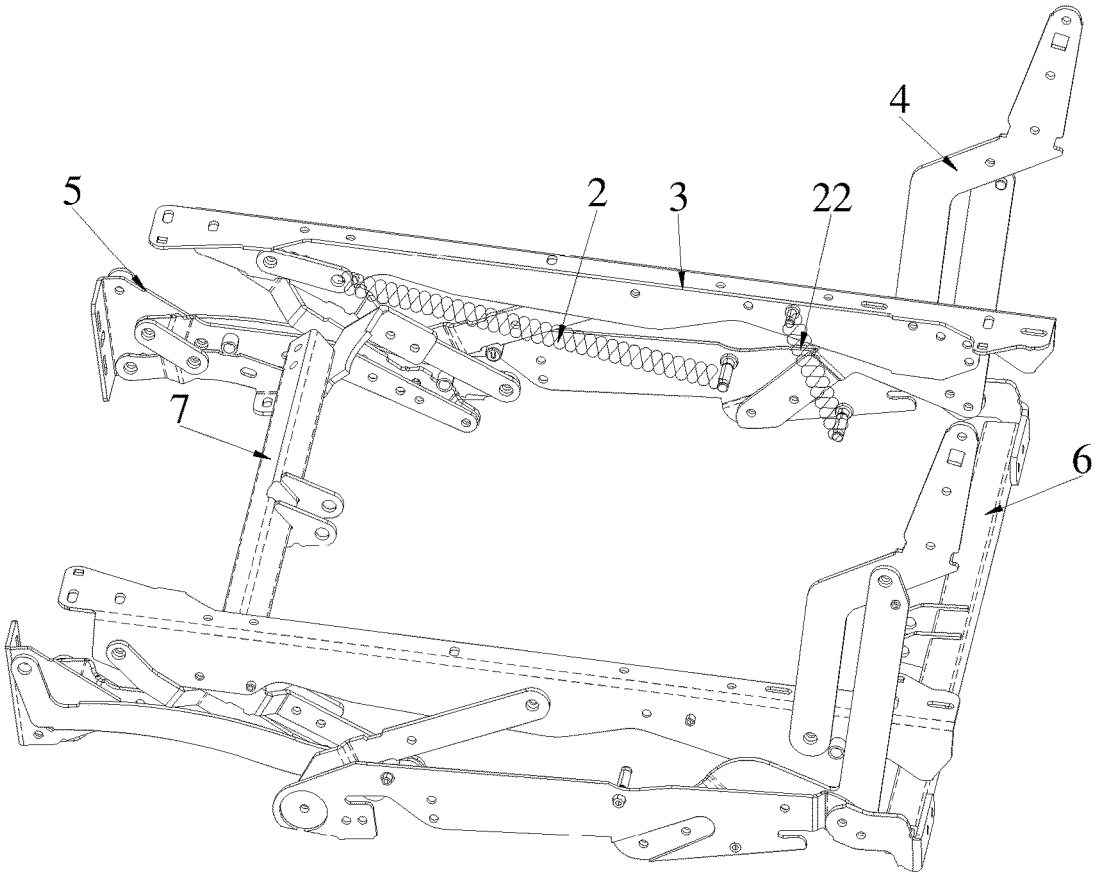
FIG. 6 is a structural diagram of a seating supporting frame in a seated position in the embodiment of the present invention.
Figure 7:
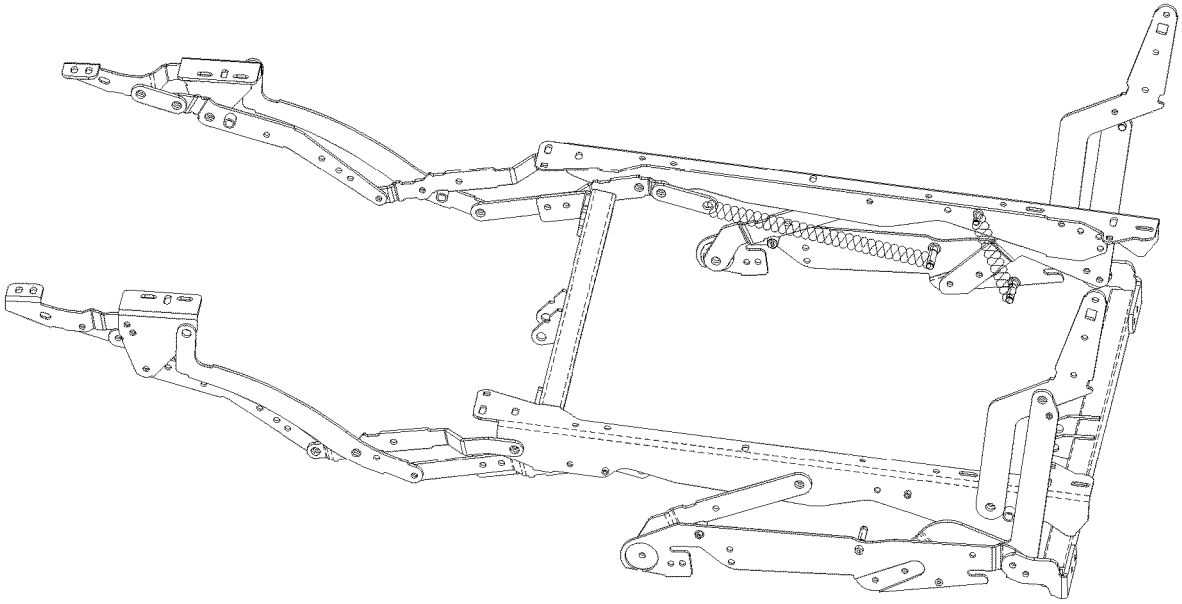
FIG. 7 is a structural diagram of a seating supporting frame in an extended position in the first embodiment of the present invention.
Figure 8:
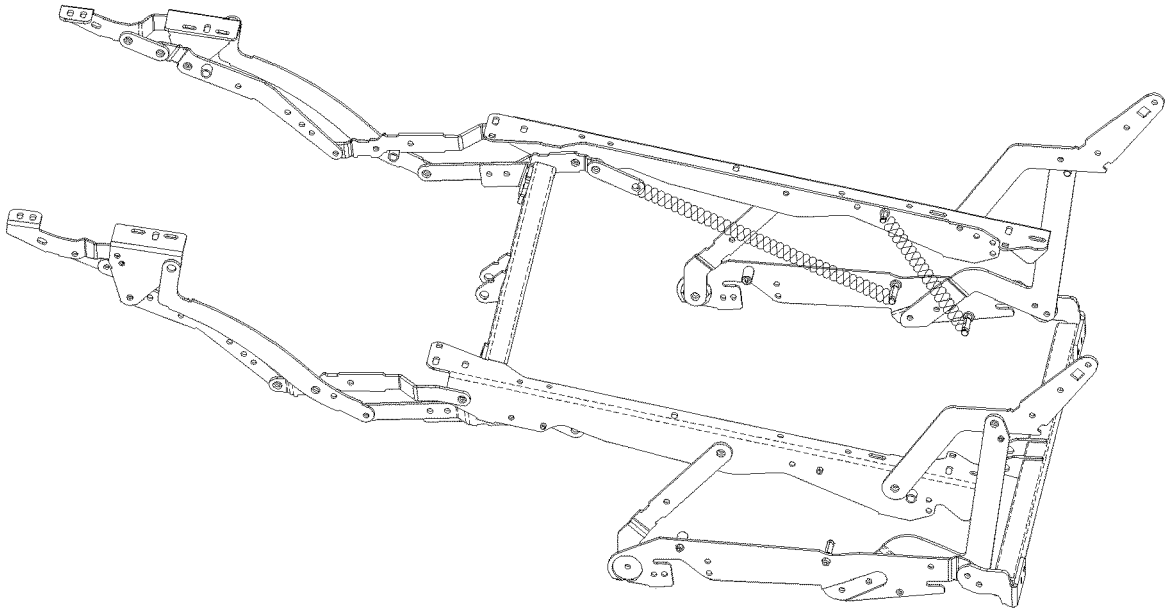
FIG. 8 is a structural diagram of a seating supporting frame in a reclined position in the first embodiment of the present invention.

Specifically, FIG. 6 to FIG. 8 show the three positions of the seating supporting frame. In practice, the seating supporting frame may be driven to switch between seated, extended, and reclined positions, which may be controlled by the driving mechanism through a remote control or a switch button. When the seating supporting frame is adjusted from the seated position to the extended position, the pusher of the driving mechanism pushes the transverse driving link 7 forward, wherein the transverse driving link 7 drives the extendable and retractable footrest mechanism 5 to extend forward, while the interconnected assembly 1 and the backrest mount 4 remain stationary. When the seat is adjusted from the extended position to the reclined position, the driving mechanism continues to drive the pusher fully extended, pushing the transverse driving link 7 and the extendable and retractable footrest mechanism 5 to extend relatively upwards, driving the seating frame 3 to rotate upwards, enabling the first transmitting part 2 to elongate and the backrest mount 4 to rotate downwards and backwards. When the seating supporting frame is adjusted for retraction from the reclined position, the elastic force for restoring the second transmitting part 22 and the body's gravity lead to a downward rotation of the seating frame for retraction, whereby the backrest mount 4 is first rotated for retraction and then retracted by the extendable and retractable footrest mechanism 5, since the head and upper body are first raised when sitting up. In the reclined position, the backrest mount 4 is retracted first; then, the extendable and retractable footrest mechanism 5 is folded back since the first transmitting part 2 pulls tightly on the extendable and retractable footrest mechanism 5. The first transmitting part 2 and the second transmitting part 22 with elastic force lead to a smoother adjustment of the seating supporting frame and ensure the sequence of movements of the backrest mount 4 and the extendable and retractable footrest mechanism 5 during the unfolding and retraction of the seat.

Figure 9:
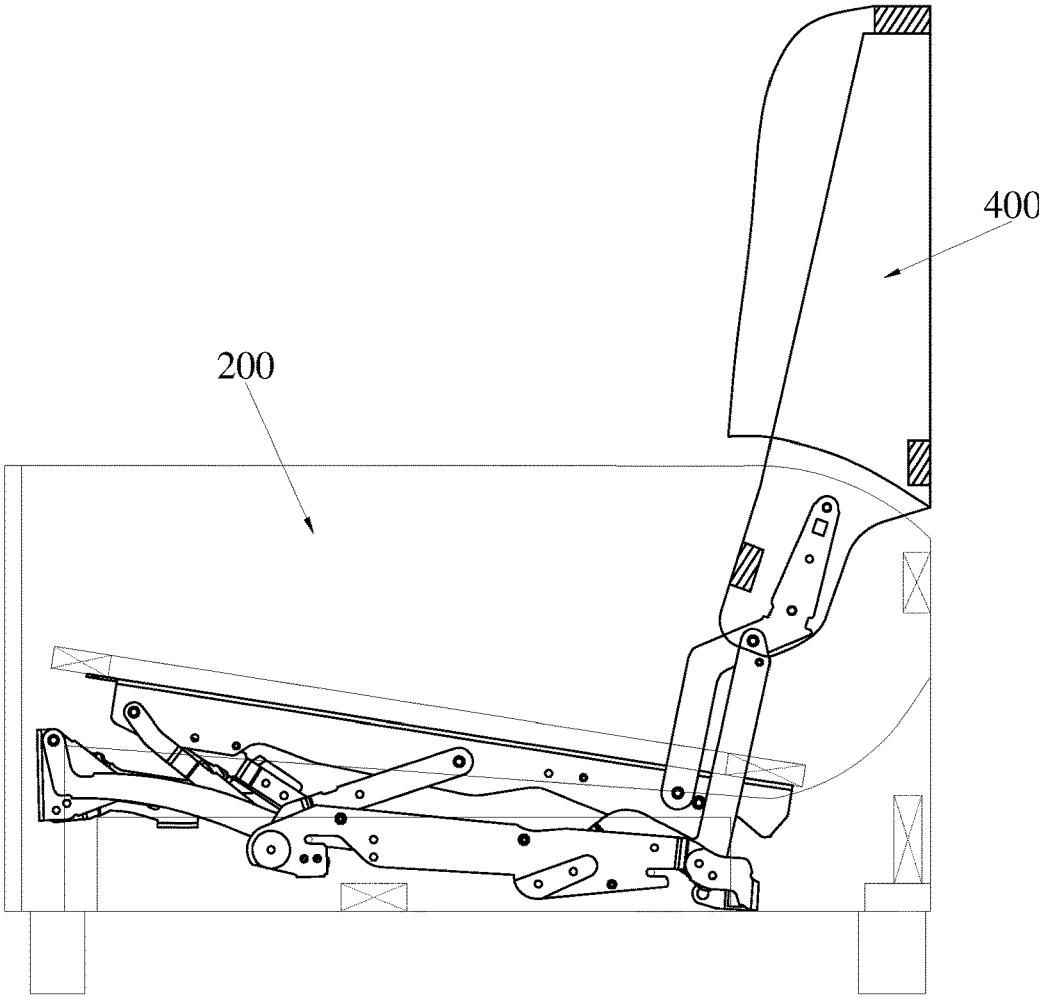
FIG. 9 is a structural diagram of the seating supporting frame, the armrest frame, and the backrest frame in the present invention.

Specifically, as shown in FIG. 9, The seating supporting frame of the present invention is fixed in the armrest frame 200 on two sides of the seat and is made into a sofa or lounge seat by installing the armrest frame 200, the backrest frame 400 and the seating frame and subsequently being upholstered. It is to be noted that in the present embodiment, the mounting plate is connected to the armrest frame 200 and maintains stationary; the backrest frame 400 may be provided as a T-shaped frame when viewed from the front of the seat, so that the two protruding ends of the T-shaped backrest frame 400 do not interfere with the armrest frame 200 and the T-shaped backrest frame 400 may be rotated around the armrest frame 200.

Figure 10:
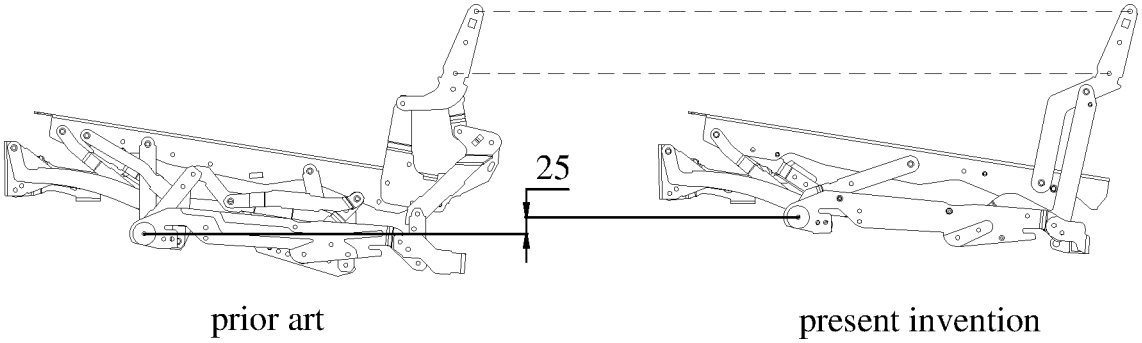
FIG. 10 shows a structural comparison of the seating supporting frame in the prior art with the seating supporting frame in the present embodiment.

As shown in FIG. 10, in comparison to the seating supporting frame in the prior art, the seating supporting frame in the present invention comprises fewer parts of the interconnected assembly 1; the backrest assembly is optimized to comprise only one backrest mount 4; the height of the seating supporting frame is significantly reduced, which leads to a compression of the height of greater than two cm as shown in FIG. 10. The structure of the extendable seating interconnected mechanism is optimized and simplified in the present invention, leading to a reduction of the manufacturing cost and a compression of the overall height of the seating supporting frame; the seat may be adjusted smoother during retracting from the reclined position by connecting the extendable and retractable footrest mechanism 5 and the interconnected assembly 1 through transmitting parts, which improves the comfort of the seat.

The invention claimed is:

1. An extendable seating interconnected mechanism, comprising an interconnected assembly, a seating frame, and a backrest mount, wherein the backrest mount is rotatably connected to the interconnected assembly and the seating frame, respectively;

the interconnected assembly comprises a mounting plate and a driving link, wherein the mounting plate comprises a lateral-plate part and a supporting part; the driving link is rotatably connected between the seating frame and the lateral-plate part; an end of the supporting part is connected to the lateral-plate part; an opposite end of the supporting part is rotatably connected to the backrest mount; the lateral-plate part and the supporting part are integrally formed into an L-shape; an angle between the lateral-plate part and the supporting part is between 90 and 100 degrees; and the supporting part extends in a direction towards the lateral-plate part to form a fixed connection close to a middle of the lateral-plate part and forms a bent shape.

2. The extendable seating interconnected mechanism according to claim 1, wherein the backrest mount is bent and formed integrally into a first segment, a second segment, and a third segment; the first segment is rotatably connected to a side of the seating frame; the second segment is rotatably connected to the supporting part; and the third segment is connected to the backrest frame of the seat.

3. A seating supporting frame, comprising an interconnected assembly, a seating frame, a backrest mount, and a first transmitting part, wherein the backrest mount is rotatably connected to the interconnected assembly and the seating frame, respectively;

the interconnected assembly comprises a mounting plate and a driving link, wherein the mounting plate comprises a lateral-plate part and a supporting part; the driving link is rotatably connected between the seating frame and the lateral-plate part; an end of the supporting part is connected to the lateral-plate part; an opposite end of the supporting part is rotatably connected to the backrest mount; and an end of the first transmitting part is connected to an extendable and retractable footrest mechanism of a seat; an opposite end of the first transmitting part is connected to the lateral-plate part; the interconnected assembly transmits pull forces to an extendable and retractable footrest mechanism through the first transmitting part.

4. The seating supporting frame according to claim 3, further comprising a second transmitting part, wherein the second transmitting part is obliquely provided between the seating frame and the lateral-plate part; an end of the second transmitting part is connected to a sidewall of the seating frame; and an opposite end of the second transmitting part is connected to an end, near the supporting part, of the lateral-plate part.

5. The seating supporting frame according to claim 4, wherein a first hinge point and a second hinge point are provided on two ends of the lateral-plate part; the lateral-plate part is connected to the driving link through the first hinge point; and the lateral-plate part is connected to the supporting part through the second hinge point.

6. The seating supporting frame according to claim 5, wherein a first fixing part is further provided on the lateral-plate part, wherein a ratio of a distance between the first fixing part and the first hinge point to a distance between the first fixing part and the second hinge point is greater than one; and the first fixing part is connected to an end of the first transmitting part.

7. The seating supporting frame according to claim 5, wherein a second fixing part is further provided on the lateral-plate part, wherein a ratio of a distance between the second fixing part and the first hinge point to a distance between the second fixing part and the second hinge point is greater than two; and the second fixing part is connected to an end of the second transmitting part.

8. The seating supporting frame according to claim 5, wherein the first transmitting part and the second transmitting part are elastic connectors with elastic recovery.

9. The seating supporting frame according to claim 3, comprising an extendable and retractable footrest mechanism, wherein the extendable and retractable footrest mechanism comprises a link assembly, a main footrest part, and a sub-footrest part assembly; the link assembly is used for driving the main footrest part and the sub-footrest assembly to extend or retract relative to the seating frame;

the link assembly comprises a first link, a second link, a third link and a fourth link, wherein the first link is connected to the second link, and the third link is connected to the fourth link; a central part of the second link is crossly connected to a central part of the third link; the first link and the third link are connected to the seating frame, respectively; and the second link and the fourth link are connected to the main footrest part, respectively.

10. The seating supporting frame according to claim 9, wherein the extendable and retractable footrest mechanism further comprises a transmitting connecting part, wherein the transmitting connecting part is provided on a side where the extendable and retractable footrest mechanism is connected to the first transmitting part; an end of the transmitting connecting part is rotatably connected to the first link; and an opposite end of the transmitting connecting part is connected to the first transmitting part.

11. The seating supporting frame according to claim 9, wherein oppositely provided on the seating supporting frame are two sets of the interconnected assembly, the seating frame, the backrest mount, the first transmitting part, and the extendable and retractable footrest mechanism.

12. The seating supporting frame according to claim 11, further comprising a transverse mounting link, a transverse driving link, and a driving mechanism, wherein two ends of the transverse mounting link are connected to two supporting parts, respectively; two ends of the transverse driving link are connected to a central part of two first links, respectively; and the driving mechanism is provided between the transverse driving link and the transverse mounting link, so as to enable the seating supporting frame to be switched between seated, extended, and reclined positions.

* * * * *